US008550247B2

(12) United States Patent
Stevens et al.

(10) Patent No.: US 8,550,247 B2
(45) Date of Patent: Oct. 8, 2013

(54) PERSONALIZED MEDICATION HOLDER

(75) Inventors: Gerard Stevens, Huntleys Point (AU); Ian Stevens, Killara (AU); Peter Stevens, Chatswood West (AU)

(73) Assignee: Manrex Pty, Ltd., Leichhardt, New South Wales (AU)

( * ) Notice: Subject to any disclaimer, the term of this patent is extended or adjusted under 35 U.S.C. 154(b) by 0 days.

(21) Appl. No.: 13/125,262

(22) PCT Filed: Oct. 20, 2009

(86) PCT No.: PCT/AU2009/001381

§ 371 (c)(1), (2), (4) Date: Jul. 27, 2011

(87) PCT Pub. No.: WO2010/045677

PCT Pub. Date: Apr. 29, 2010

(65) Prior Publication Data

US 2011/0272314 A1 Nov. 10, 2011

(30) Foreign Application Priority Data

Oct. 21, 2008 (AU) ..... 2008101035

(51) Int. Cl.
*B65D 83/04* (2006.01)
*B65D 85/42* (2006.01)

(52) U.S. Cl.
USPC ..... 206/534; 206/538

(58) Field of Classification Search
USPC ..... 206/438, 439, 363, 528, 534, 538, 539, 206/524.1, 570
See application file for complete search history.

(56) References Cited

U.S. PATENT DOCUMENTS

| | | | | |
|---|---|---|---|---|
| 3,154,225 | A | 10/1964 | Wadlinger | |
| 3,503,493 | A * | 3/1970 | Nagy | 206/232 |
| 4,049,121 | A * | 9/1977 | White | 206/439 |
| 4,209,126 | A | 6/1980 | Elias | |
| 4,691,820 | A * | 9/1987 | Martinez | 206/205 |
| D363,601 | S * | 10/1995 | Abrams et al. | D3/264 |
| 5,620,087 | A | 4/1997 | Martin | |
| 6,155,423 | A * | 12/2000 | Katzner et al. | 206/531 |
| 2006/0086640 | A1 | 4/2006 | Luciano, Jr. | |
| 2007/0131576 | A1* | 6/2007 | Ehling et al. | 206/528 |
| 2010/0089784 | A1* | 4/2010 | Kanda et al. | 206/439 |
| 2011/0253573 | A1* | 10/2011 | Brinker | 206/438 |

OTHER PUBLICATIONS

Alex Quek, International Search Report for PCT/AU2009/001381, Dec. 17, 2009.

* cited by examiner

*Primary Examiner* — Luan K Bui
*Assistant Examiner* — Rafael Ortiz
(74) *Attorney, Agent, or Firm* — Chernoff Vilhauer McClung & Stenzel, LLP

(57) ABSTRACT

A holder (100) for storing prescribed medication doses in a sealed cup (112) is provided with a sealing strip (117) a first portion (110) of which covers the mouth of the cup and a second portion (120) carries a picture of the face of the patient for whom the medication has been prescribed. The holder (100) is provided with a rim (113) extending outwardly from the mouth of the cup and with an extension flange (114) having a flat upper surface (111) which is coplanar with the upper surface of the rim (113). The sealing strip adheres to the coplanar surfaces of the rim (113) and the flange (114) and is provided with lines of severance (130 and 131) extending from a pull-tab (151) and along opposite sides of the cup. These lines of severance (130 and 131) are arranged within the confines of the path of the seal between the sealing strip (117) and the rim (113) so that air cannot leak through the lines of severance and into the cup when storing medication doses within the holder. The pull-tab enables the first portion (110) of the sealing strip (117) to be peeled back from covering the cup so that its contents can be accessed by inverting the cup over the palm of the hand of the user.

1 Claim, No Drawings

PERSONALIZED MEDICATION HOLDER

This is a national stage application filed under 35 USC 371 based on International Application No. PCT/AU2009/001381 filed Oct. 20, 2009, and claims priority under 35 USC 119 of Australian Patent Application No. 2008101035 filed Oct. 21, 2008.

FIELD OF THE INVENTION

This invention relates to the administration of doses of prescribed solid medication to a patient and is more specifically concerned with the provision of a hermetically sealed holder containing the medication doses and which is easily opened, the holder having a portion of a strip adhering to it which positively identifies the patient to whom the medication is to be administered. This ensures that the patient can be positively identified from the holder before it is opened, and, after administration, the open holder indicates the identity of the patient for whom the medication was intended and the nature of the medication itself.

THE PRIOR ART

It has been proposed to provide solid medication in rectangular sealed sachets of a thin flexible and disposable material. Each sachet contains doses of prescribed medication which are to be administered to a particular patient at a specified time on a specified day. These sachets are supplied in the form of a continuous string having lines of transverse perforations enabling individual sachets of the string to be detached from one another as required. The string may be provided in a coiled form in a dispenser on which the identity of the patient is displayed. The name of the patient may also appear on the individual sachets of the coil.

Nursing homes and other aged-care facilities may require a qualified nurse to administer medication to a large number of patients. The dispensers for the patients are often stored together for convenience. The nurse will detach a sachet from the dispenser corresponding to a particular patient and take the sachet to the patient. The sachet will then be broken open in the presence of the patient and the medication administered. In some cases the action of breaking open the sachet will destroy the print giving the patients name so that it becomes illegible.

To save time it sometimes happens that a nurse required to administer medication doses to more than one patient at a particular time will take the sachets from more than one dispenser in the store. This enables the nurse to provide medication to different patients without having to return to the store after each administration in order to obtain a fresh sachet. However there is then a risk of the nurse confusing one sachet with another if the sachets are not marked with the patients' names. This can result in incorrect medication being administered to a patent. Moreover it sometimes happens that two patients share the same name. This also can result in the two patients receiving each other's medication.

OBJECT OF THE INVENTION

An object of this invention is to reduce the risk of medication being administered incorrectly.

THE INVENTION

In accordance with one aspect of the invention a medication holder in the form of a cup having a stiff coplanar rim from which an integrally-moulded flange having a flat upper surface coplanar with that of the rim extends outwardly from one side of the cup, there being solid medication doses hermetically sealed within the cup cavity by a section of a first portion of a sealing strip which adheres in a manually-releasable manner to the coplanar upper surface of the rim, a second portion of the sealing strip adhering to the flat upper surface of the flange, information positively identifying the patient for whom the medication doses are intended being displayed on one of the two portions, and a manually-operable device provided on the strip and from which a line or lines of severance extend within the confines of the path of the seal formed between the rim and the first portion of the strip, the shape and position of the severance line or lines being such that the device can be used to lift the section of the first portion of the strip covering the cup cavity without detaching the second portion of the strip from the flange.

In accordance with a second aspect of the invention a medication holder made from moulded plastics material and formed with a cup having a rim with a coplanar upper surface; an integrally moulded flange on the holder having a flat upper surface that is coplanar with that of the rim and extends away from one side of the cup; solid medication doses disposed within the cup; a first portion of a sealing strip adhering in a manually-releasable manner to the coplanar surfaces of the rim and the flange to keep the medication doses in place; a second portion of the sealing strip which adheres to the flange displaying information positively identifying the patient for whom the medication doses are intended; and, a line of severance on the strip enabling the first portion covering the cup cavity to be manually detached from the rim of the cup without disturbing the second portion.

An advantage of the invention is that it enables a check on the identity of the patient to be confirmed from the second portion of the strip by a nurse in the presence of the patient and before the cup is opened and the medication doses are administered. Also, after the administration of the medication doses there is a permanent record on the holder that a particular identified patient has received the prescribed medication it contained.

PREFERRED FEATURES OF THE INVENTION

Suitably the free end of the flange is provided with a square-cut end and a flat undersurface. This enables a rectangular extension flap on the second portion of the strip to be folded around the square-cut end and into adherent contact with the flat undersurface of the flange. The exposed surface of the flap may, for example, identify the individual medication doses contained in the cup. This configuration of the strip enables all of the required information on the strip to be printed on one side of it before it is used to seal the prescribed medication doses into the cup. A pressure-sensitive cold sealing strip is preferably used.

In another arrangement the line of severance is formed as a closed loop extending around the printed information on the second portion of the strip in adherent contact with the flange.

The invention enables a string of identical holders to be held together by a printed sheet which provides the sealing strips of the holders. The sheet may be in the form of a strip of extended length. To facilitate individual detachment of a holder from the string, the sheet may be provided with lines of weakness such as perforations, extending between the holders. If the sheet is of extended length the set of holders may be spaced from one another. It is also conceivable that the sheet may be rectangular and formed with a net of lines of weakness so that the individual holders can be located in respective interstices in the net.

Although it is preferred to form the holder from a moulded plastics material, the nature of the material from which it is formed and the process by which the holder is made are not essential to the carrying out of the invention.

INTRODUCTION TO THE DRAWINGS

The invention will now be described in more detail, by way of examples, with reference to the accompanying drawings, in which:

IN THE DRAWINGS

Figure 6:
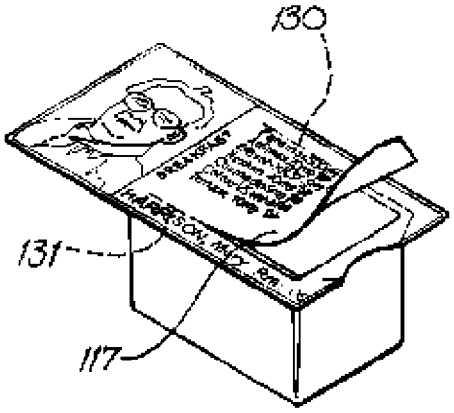
FIG. 6 shows a stage in the opening of the holder of FIG. 5 to give access to the medication doses.
Figure 7:
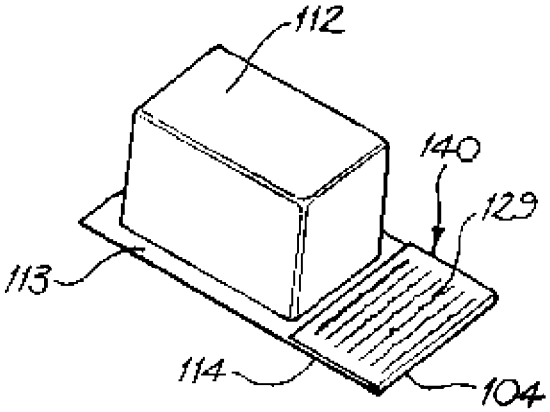
Figure 8:
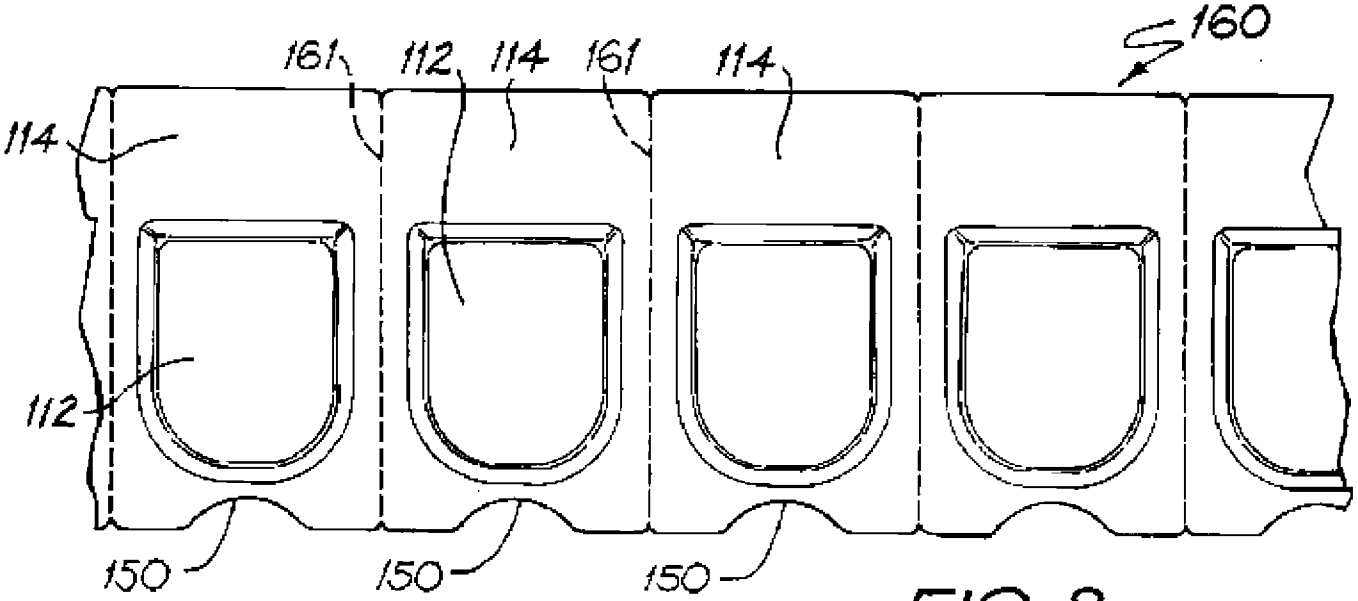
Figure 9:
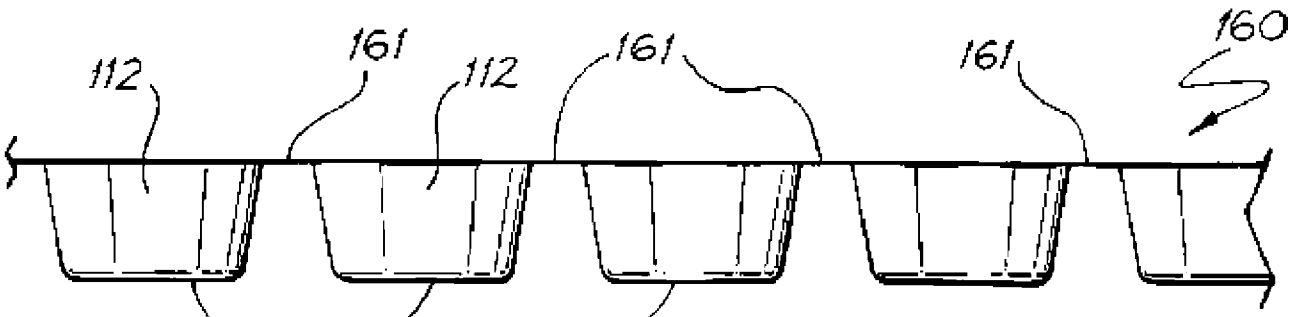

FIG. 7 shows the holder of FIG. 6 inverted after removal of the medication doses and displaying the legend giving the contents of the cup and which is printed on the underside of a flange of the holder; and, FIGS. 8 and 9 respectively show in plan and side views a string of holders held together by an elongated sheet which has sections of its length providing sealing strips for respective holders, the sheet having lines of weakness extending between its opposite sides and disposed between the holders to facilitate their detachment from the sheet.

In the accompanying descriptions of the embodiments of the invention illustrated in the drawings the same reference numerals have been used for similar parts, but in the case of the first embodiment the numerals are in the "ten" series and in the case of the second embodiment they are in the "hundred" series.

DESCRIPTION OF FIRST EMBODIMENT

Figure 1:
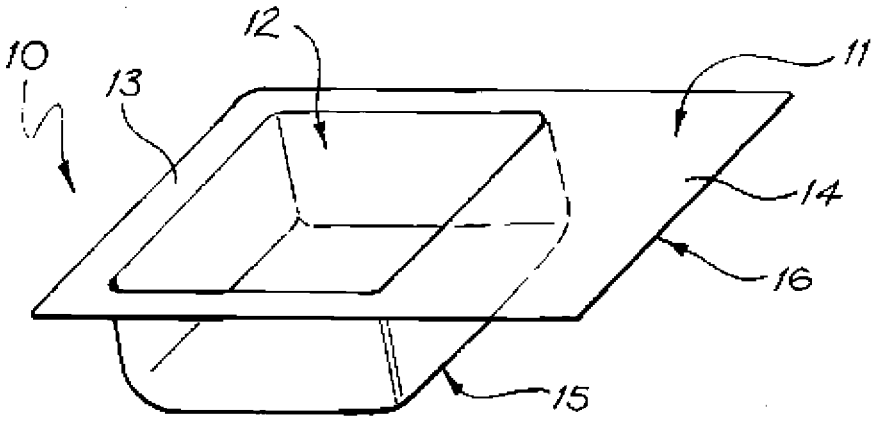
FIG. 1 is a perspective view of an empty plastics holder prior to a cup, forming part of the holder, being loaded with medication doses.

FIG. 1 shows a holder 10 moulded from a transparent plastics material to provide a cup 12 of substantially square cross-section surrounded by an outwardly-turned, coplanar, stiff rim 13 which is extended on one side to provide a rectangular flange 14. The flange 14 has a flat upper surface 11 which is coplanar with the rim 13 of the holder, and a flat lower surface. The edge of the flange remote from the cup 12 is square-cut and is referenced 16.

In this embodiment the thickness of the plastics material of the cup 12 diminishes towards its base 15. This provides the base with a high degree of flexibility enabling it to be easily pushed upwardly into the cavity of the cup by finger pressure to facilitate the removal of medication doses which have been loaded into the cup interior.

Figure 2:
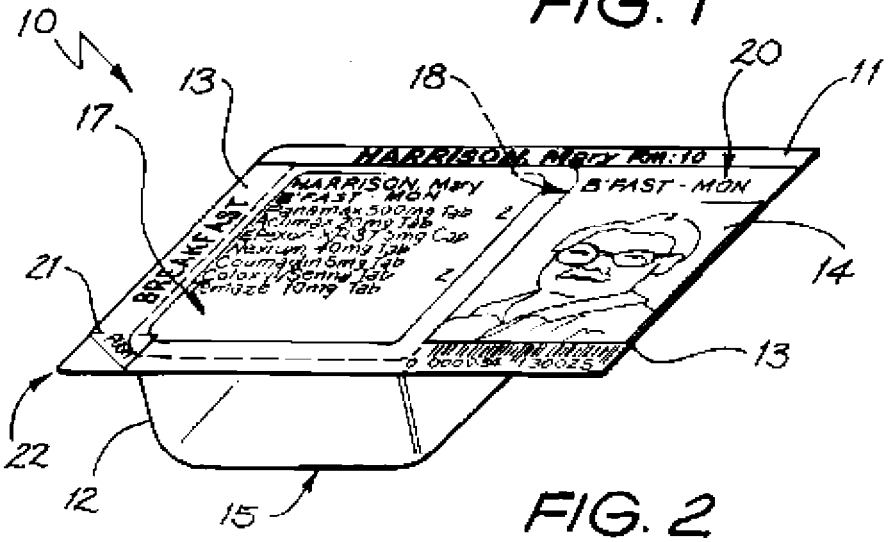
FIG. 2 shows the holder of FIG. 1 after the cavity of the cup has been loaded with doses of medication and sealed by a first portion of a foil sealing strip.

FIG. 2 shows the holder 10 of FIG. 1 after its cup 12 has been loaded with medication doses as prescribed by a doctor, and sealed by a rectangular pressure-sensitive adhesive flexible sealing strip 17 which adheres to the upper surface of the flange 14 and to the rim 13 of the cup as well as to other parts of the holder. The strip 17 is divided by a line of severance 18 having rounded corners, into a first portion 19 closing the cavity of the cup 12 and adhering to the inner part of its rim 13, and a second portion 20 comprising the remainder of the strip 17. The line of severance 18 extends along the path of a hermetic seal formed between the rim 13 and the first portion 19 and enables the first and second portions 19 and 20 of the strip 17 to be readily separated from one another. This is achieved by manually pressing down a device 21 marked "push" and provided in one corner 22 of the holder, the device 21 being located beneath one corner of the line of severance 18 as shown. The sealing strip at the associated corner of the line of severance can then be lifted up by being gripped between the fingers so that it no longer covers the cup. This may be assisted by pressing the flexible base 15 of the cup upwardly.

The upper surface of the strip 17 is printed so that the central region of its first portion 19 identifies the name of the patient for whom the medication doses have been prescribed. The first portion also lists the time at which the medication is to be taken; and, the nature of the medication doses within the cup.

Figure 3:
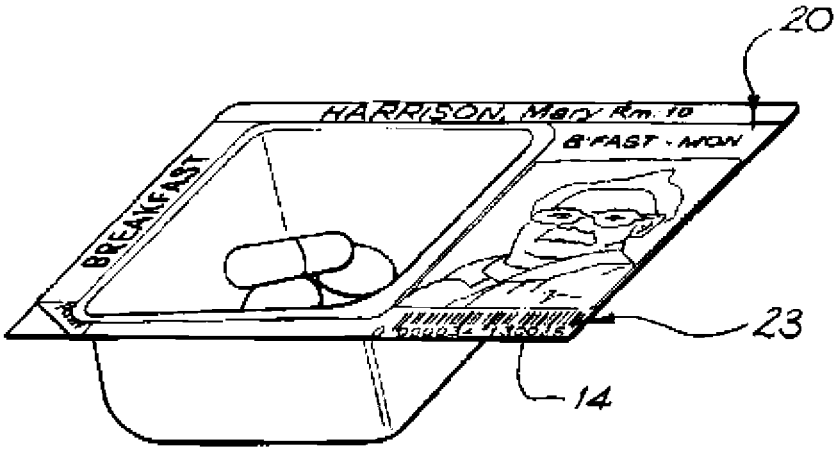
FIG. 3 shows the holder of FIG. 2 after removal of the first portion of a sealing strip so that the medication doses in the cup are exposed for removal.

As shown in FIG. 3, the second portion 20 of the strip adhering to the upper flat face of the flange 14, is printed with a picture of the face of the patient, the time at which the medication doses in the cup are to be taken, and a bar code 23 which provides in coded form all of the printed information mentioned above. As illustrated, the name of the patient also appears along one margin of the strip so that it remains in place after removal of the central region of the first portion 19 of the strip 17.

DESCRIPTION OF SECOND EMBODIMENT

Figure 4:
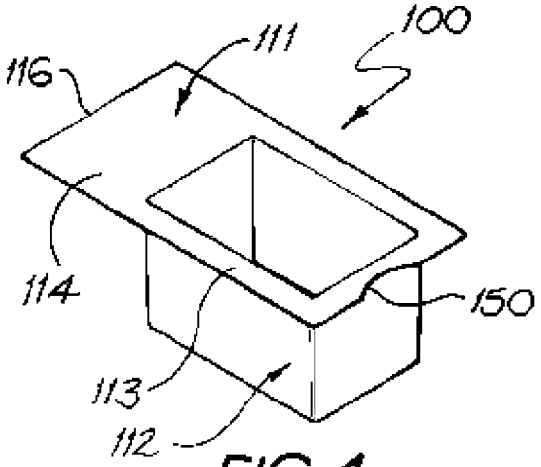
FIG. 4 is a perspective view of a second form of holder which is shown empty.

FIG. 4 shows a holder 100 made from a rigid moulded plastics or some other material. The holder provides a cubical cup 112 into which prescribed medication doses can be placed and stored until required for use. The mouth of the cup is surrounded by an outwardly-turned flat rim 113 having its upper surface coplanar with the upper surface 111 of a rectangular flange 114 which extends outwardly from the cup 112 at one side of the holder 100. The rim 113 is provided centrally at its edge opposite the flange 114 with a device in the form of a part-circular cut-out 150.

Figure 5:
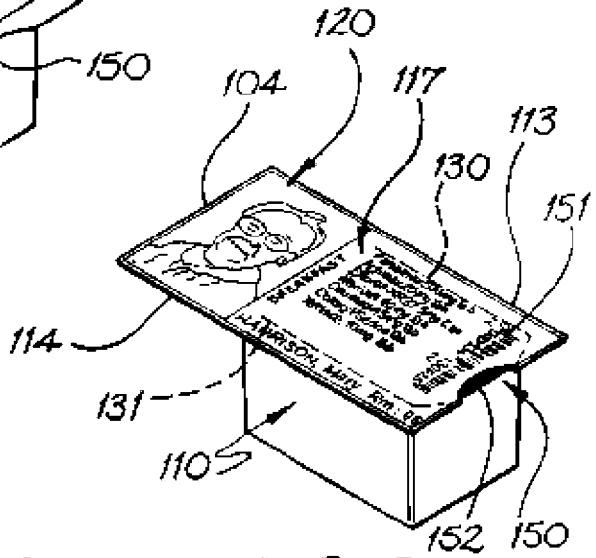
FIG. 5 shows the holder of FIG. 4 hermetically sealed by a sealing strip and having a cup containing medication doses within its cavity which is closed by the sealing strip.

As is shown in FIG. 5, the coplanar surfaces of the rim 113 and the flange 114 are covered by an adhering sealing strip 117. A first portion 119 of the sealing strip 117 covers the cavity of the cup 112 and a second portion 120 adheres to the upper surface of the flange 114. The strip 117 has an extension flap 140 which wraps around the square-cut edge 104 of the end of the flange 114 and adheres to the flat underside of the flange 114 as shown in FIG. 7. The nature of the medication within the cup 112 is written on the exposed face of the flap 140 as is diagrammatically illustrated at 129 in FIG. 7.

The second portion 120 of the strip 117 carries a picture of the patient to whom the prescribed medication is to be administered. The first portion 119 lists the nature of the medication doses in the cavity of the cup 112. Other information contained on or adjacent the first portion 119 identifies the patient by name, and the time at which the medications doses are to be administered. All of this information is encoded in a bar code 151 on the first portion 1119 of the sealing strip.

As is apparent from FIG. 5 part of the sealing strip 117 overlaps the cut-out 150 to provide a pull-tab 152 for releasing the first portion 119 of the sealing strip 117 from the mouth of the cup 112. This release is achieved by a pair of severance lines 130,131 respectively formed through the sealing strip 117 and extending from the pull-tab 152 along the paths of the seal formed between the sealing strip and the rim 113 at opposite sides of the cup 112. This is apparent from FIG. 6 which shows the portion 119 of the sealing strip 117 partially lifted from the top of the cup 112. As the lines of severance 130,131 extend within the confines of the path of the seal on the rim 113 leakage of air through the severance lines and into the cup 112 when it is closed by the sealing strip 117, is avoided. It will also be noticed from FIGS. 5 and 6 that the two lines of severance 130,131 terminate at the end of the cup 112 opposite the cut-out 150. Thus the cup can be fully opened without totally detaching any part of the sealing strip 117 from the holder 100. Once opened, the medication doses can be accessed by simply inverting the cup over the palm of the hand.

FIGS. 8 and 9 show how a set of holders 100 as shown in the second of the embodiments described, can be connected together so that they can be provided in the form of a coil (not shown). Individual holders 100 can be detached from the outer end of the coil as required.

After the holders have been arranged side-by-side as shown in FIG. 8 and their cups 112 filled with the required prescribed medication doses, an elongated sheet 160 providing the sealing strips 117 for the holders 100 can be laid over the top of the line of holders and cold sealed to their rims 113 and flanges 114. The elongated sheet 160 is provided with lines of weakness 161 such as perforations, each of these lines being located between a pair of holders as shown in FIG. 9. Once each of the holders 100 has been sealed, the elongated sheet 160 with the string of holders can be coiled up in readiness for use.

The advantage of this way of handling the holders 110 is that even though the holders may have been detached from the coil they can each be visually correlated with the requirements of a particular patient whose face and name appear on the holder. It should be born in mind that it is not uncommon for two patients in an aged care facility to have the same name and, a clear distinction cannot always be made between two different patients.

MODIFICATIONS OF THE EMBODIMENTS

In one modification of the embodiments the picture of the face of the patient which is necessary to provide the positive identification, is provided on the first portion of the sealing strip rather than the second portion.

In a second modification of the embodiments the information concerning the nature of the contents of the cup is provided on a label adhered to the underside of the flange and which is separate from the sealing strip.

In a third modification of the embodiments the adherence of the sealing strip to the holder is achieved by some other acceptable technique than cold pressure sealing.

The invention claimed is:

1. A medication holder made from moulded plastics material and formed with a cup defining a cup cavity and having a rim with a flat upper surface; an integrally moulded flange on the holder having a flat upper surface that is coplanar with the flat upper surface of the rim and extends away from one side of the cup; solid medication doses disposed within the cup; a first portion of a sealing strip adhering in a manually-releasable manner to the coplanar upper surfaces of the rim and the flange to keep the medication doses in place; a second portion of the sealing strip which adheres to the flange displaying information positively identifying the patient for whom the medication doses are intended; and, a line of severance on the strip enabling the first portion covering the cup cavity to be manually detached from the rim of the cup without disturbing the second portion, and wherein the free end of the flange remote from the cup is provided with a square-cut end and a flat undersurface, and an extension flap on the second portion of the strip is folded around the square-cut end and adheres to the flat undersurface of the flange, the extension flap identifying on its exposed face the individual medication doses within the cup.

* * * * *

UNITED STATES PATENT AND TRADEMARK OFFICE

CERTIFICATE OF CORRECTION

PATENT NO. : 8,550,247 B2
APPLICATION NO. : 13/125262
DATED : October 8, 2013
INVENTOR(S) : Stevens et al.

It is certified that error appears in the above-identified patent and that said Letters Patent is hereby corrected as shown below:

Delete title page and substitute therefore with the attached title page consisting of the corrected number of drawing sheets and illustrative figure.

Add the attached Drawing Sheets 1-3 consisting of FIGS. 1-9 to said patent.

Signed and Sealed this
Twenty-third Day of February, 2016

Michelle K. Lee

Michelle K. Lee
*Director of the United States Patent and Trademark Office*

(12) United States Patent
Stevens et al.

(10) Patent No.: US 8,550,247 B2
(45) Date of Patent: Oct. 8, 2013

(54) PERSONALIZED MEDICATION HOLDER

(75) Inventors: Gerard Stevens, Huntleys Point (AU); Ian Stevens, Killara (AU); Peter Stevens, Chatswood West (AU)

(73) Assignee: Manrex Pty. Ltd., Leichhardt, New South Wales (AU)

( * ) Notice: Subject to any disclaimer, the term of this patent is extended or adjusted under 35 U.S.C. 154(b) by 0 days.

(21) Appl. No.: 13/125,262

(22) PCT Filed: Oct. 20, 2009

(86) PCT No.: PCT/AU2009/001381

§ 371 (c)(1).
(2), (4) Date: Jul. 27, 2011

(87) PCT Pub. No.: WO2010/045677

PCT Pub. Date: Apr. 29, 2010

(65) Prior Publication Data

US 2011/0272314 A1 Nov. 10, 2011

(30) Foreign Application Priority Data

Oct. 21, 2008 (AU) ..... 2008101035

(51) Int. Cl.
*B65D 83/04* (2006.01)
*B65D 85/42* (2006.01)

(52) U.S. Cl.
USPC ..... 206/534; 206/538

(58) Field of Classification Search
USPC ..... 206/438, 439, 363, 528, 534, 538, 539, 206/524.1, 570
See application file for complete search history.

(56) References Cited

U.S. PATENT DOCUMENTS

| | | | | |
|---|---|---|---|---|
| 3,154,225 | A | 10/1964 | Wadlinger | |
| 3,503,493 | A * | 3/1970 | Nagy | 206/232 |
| 4,049,121 | A * | 9/1977 | White | 206/439 |
| 4,209,126 | A | 6/1980 | Elias | |
| 4,691,820 | A * | 9/1987 | Martinez | 206/205 |
| D363,601 | S * | 10/1995 | Abrams et al. | D3/264 |
| 5,620,087 | A | 4/1997 | Martin | |
| 6,155,423 | A * | 12/2000 | Katzner et al | 206/531 |
| 2006/0086640 | A1 | 4/2006 | Luciano, Jr. | |
| 2007/0131576 | A1* | 6/2007 | Ehling et al. | 206/528 |
| 2010/0089784 | A1* | 4/2010 | Kanda et al. | 206/439 |
| 2011/0253573 | A1* | 10/2011 | Brinker | 206/438 |

OTHER PUBLICATIONS

Alex Quek, International Search Report for PCT/AU2009/001381, Dec. 17, 2009.

* cited by examiner

*Primary Examiner* — Luan K Bui
*Assistant Examiner* Rafael Ortiz
(74) *Attorney, Agent, or Firm* — Chernoff Vilhauer McClung & Stenzel, LLP

(57) ABSTRACT

A holder (100) for storing prescribed medication doses in a sealed cup (112) is provided with a sealing strip (117) a first portion (110) of which covers the mouth of the cup and a second portion (120) carries a picture of the face of the patient for whom the medication has been prescribed. The holder (100) is provided with a rim (113) extending outwardly from the mouth of the cup and with an extension flange (114) having a flat upper surface (111) which is coplanar with the upper surface of the rim (113). The sealing strip adheres to the coplanar surfaces of the rim (113) and the flange (114) and is provided with lines of severance (130 and 131) extending from a pull-tab (151) and along opposite sides of the cup. These lines of severance (130 and 131) are arranged within the confines of the path of the seal between the sealing strip (117) and the rim (113) so that air cannot leak through the lines of severance and into the cup when storing medication doses within the holder. The pull-tab enables the first portion (110) of the sealing strip (117) to be peeled back from covering the cup so that its contents can be accessed by inverting the cup over the palm of the hand of the user.

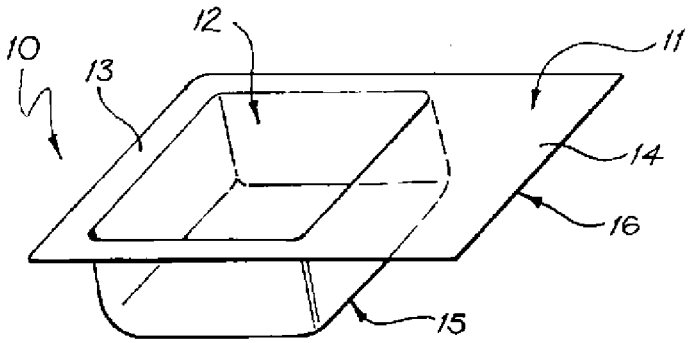

1 Claim, 3 Drawing Sheets